US011958515B2

(12) United States Patent
Braband

(10) Patent No.: US 11,958,515 B2
(45) Date of Patent: Apr. 16, 2024

(54) METHOD AND APPARATUS FOR IDENTIFYING PROPERTIES OF A VEHICLE, COMPUTER PROGRAM PRODUCT AND COMPUTER-READABLE MEDIUM FOR STORING AND/OR PROVIDING THE COMPUTER PROGRAM PRODUCT

(71) Applicant: Siemens Mobility GmbH, Munich (DE)

(72) Inventor: Jens Braband, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 17/994,561

(22) Filed: Nov. 28, 2022

(65) Prior Publication Data

US 2023/0166781 A1 Jun. 1, 2023

(30) Foreign Application Priority Data

Nov. 26, 2021 (EP) ..... 21210630

(51) Int. Cl.
*B61L 25/02* (2006.01)
*B61L 25/04* (2006.01)

(52) U.S. Cl.
CPC ..... *B61L 25/021* (2013.01); *B61L 25/04* (2013.01)

(58) Field of Classification Search
CPC ..... B61L 25/021; B61L 25/04; B61L 29/32; B61L 1/14; B61L 25/028; B61L 1/161
See application file for complete search history.

(56) References Cited

U.S. PATENT DOCUMENTS 5,803,411 A * 9/1998 Ackerman ..... B61L 3/121 701/19
5,813,635 A * 9/1998 Fernandez ..... B61L 25/021 246/168

(Continued)

FOREIGN PATENT DOCUMENTS

EP 1279581 A1 1/2003
EP 2236387 A1 10/2010

(Continued)

OTHER PUBLICATIONS

Zasov Valery A et al: "Geometry-Based Rolling-Stock Identification System Insensitive to Speed Variations", 2020 IEEE East-West Design & Test Symposium (EWDTS), IEEE, Sep. 4, 2020 (Sep. 4, 2020), pp. 1-6, XP033842967, DOI: 10.1109/EWDTS50664.2020.9224911 [retrieved Oct. 14, 2020].

(Continued)

*Primary Examiner* — Kurt Philip Liethen
(74) *Attorney, Agent, or Firm* — Laurence A. Greenberg; Werner H. Stemer; Ralph E. Locher

(57) ABSTRACT

A method for identifying properties of rail-guided vehicles uses an axle counter to detect vehicle measurement data as the vehicle crosses. The measurement data are analyzed in a computer and speed and distances between vehicle axles are ascertained. A property of the vehicle is ascertained in a computer based on the ascertained speed and distances between axles. A checking step ascertains a pattern of normal distances between axles in that a normal distance between axles calculated by considering a predefined normal speed is assigned to each ascertained distance between axles, and by considering their order, the normal distances between axles merge to form the pattern. The pattern is compared with reference patterns, and upon identified conformity of the pattern and reference pattern, a type linked to the (Continued)

reference pattern is assigned to the vehicle as a property. An apparatus and computer program determining properties of vehicles are also provided.

13 Claims, 4 Drawing Sheets

(56) References Cited

U.S. PATENT DOCUMENTS

| | | | | |
|---|---|---|---|---|
| 8,509,969 | B2 * | 8/2013 | Chen | B61L 25/045 701/19 |
| 9,493,176 | B2 * | 11/2016 | Busse | B61L 29/28 |
| 2002/0072833 | A1 * | 6/2002 | Gray | B61L 27/53 701/19 |
| 2014/0129154 | A1 * | 5/2014 | Cooper | B61L 23/042 702/34 |
| 2014/0313503 | A1 * | 10/2014 | Bennett | G01S 7/4808 356/28 |
| 2017/0212142 | A1 * | 7/2017 | Salzgeber | G01P 3/50 |
| 2023/0166781 | A1 * | 6/2023 | Braband | B61L 25/028 701/19 |

FOREIGN PATENT DOCUMENTS

| | | | | |
|---|---|---|---|---|
| EP | 2718168 | B1 | 6/2017 | |
| EP | 4186775 | A1 | 5/2023 | |
| JP | 2007097378 | A * | 4/2007 | B61L 25/02 |
| RU | 2000978 | C1 | 10/1993 | |

OTHER PUBLICATIONS

Myounggyu Won: "Intelligent Traffic Monitoring Systems for Vehicle Classification: A Survey", arxiv.org, Cornell University Library, 201 Olin Library Cornell University Ithaca, NY 14853, Oct. 10, 2019 (Oct. 10, 2019), XP081513641.

* cited by examiner

METHOD AND APPARATUS FOR IDENTIFYING PROPERTIES OF A VEHICLE, COMPUTER PROGRAM PRODUCT AND COMPUTER-READABLE MEDIUM FOR STORING AND/OR PROVIDING THE COMPUTER PROGRAM PRODUCT

CROSS-REFERENCE TO RELATED APPLICATION

This application claims the priority, under 35 U.S.C. § 119, of European Patent Application EP 21210630.6, filed Nov. 26, 2021; the prior application is herewith incorporated by reference in its entirety.

FIELD AND BACKGROUND OF THE INVENTION

The invention relates to a method for identifying properties of a rail-guided vehicle, in which an axle counter detects measurement data as the rail-guided vehicle crosses, the measurement data are analyzed in a computer-assisted manner and a speed and distances between axles of the vehicle are ascertained and a property of the rail-guided vehicle is ascertained in a computer-assisted manner on the basis of the ascertained speed and the ascertained distances between axles. In addition, the invention relates to apparatus for determining properties of rail-guided vehicles, including at least one axle counter for detecting measurement data as the vehicles cross and a computer, which is adapted to analyze the measurement data and to ascertain a speed and distances between axles of the vehicle, and on the basis of the ascertained speed and the ascertained distances between axles, to ascertain a property of the vehicle (FZ). Lastly the invention relates to a computer program product and a provisioning apparatus or medium for the computer program product, wherein the computer program product is equipped with program commands for carrying out the method.

Conventional safety technology in rail operation does not identify many properties of rail-guided vehicles (hereinafter also called rail vehicle or train), such as the train type (for example freight train, regional train, locomotive etc.), and instead knows only logical properties, for example the occupancy of a track clearance section. Operations control technology, on the other hand, knows this type and optionally further properties of the train, but, as a rule, these cannot be used as a basis for safe decisions because they themselves do not demonstrate the necessary safety level. Nevertheless, for train operation in particular operating situations it is necessary to define the train type with the necessary level of safety. Nowadays this occurs by way of a mixture of technical and operational methods, in part with considerable expenditure.

Types of train, called train category in Switzerland, are categories of different trains. Trains are classified with regard to their use, according to their significance for transport and on the basis of their treatment in terms of train operation. Each train is designated by the train type and a train number.

The designations for the types of train vary; apart from the colloquial designations, there are thus also technical names, and, more precisely, transportation-related terms, designations that have evolved from the time of state railroads by way of regulations and brand names of the railroad companies. Regardless of which types of train are used, they make it possible to provide more accurate details on the running trains, however. These can be stored, for example, in a train automation system and used for control tasks.

European Patent EP 2 718 168 B1, corresponding to U.S. Pat. No. 9,493,176 B2, relates to a method for operating a railway safety system having at least one trackside device while taking into account a measured velocity value recorded when the rail vehicle drives into the switch-on section of the railway safety system. The measured velocity value is used when the rail vehicle drives into the switch-on section as the basis for checking whether a correction time for forwarding a signal from the one trackside device to an associated railway safety system is to be set according to the measured velocity value. Thereafter a set correction time is checked to determine whether the set correction time should remain effective as a function of at least one further influencing variable of the rail vehicle that determines the travel time.

SUMMARY OF THE INVENTION

It is accordingly an object of the invention to provide a method and an apparatus for identifying properties of a vehicle, a computer program product and a computer-readable medium for storing and/or providing the computer program product, which overcome the hereinafore-mentioned disadvantages of the heretofore-known methods and apparatuses of this general type and which identify, with low expenditure (for example as far as possible without additional sensor systems having to be installed, with low computational effort in respect of hardware and software), the train type sufficiently reliably in such a way that the identified train type can be used in the safety technology of railroad operation. In addition, the object of the invention includes providing a computer program product and a provisioning apparatus or medium for this computer program product with which the method can be carried out.

With the foregoing and other objects in view there is provided, in accordance with the invention, a method for identifying properties of a rail-guided vehicle, wherein an axle counter detects measurement data as the rail-guided vehicle crosses, the measurement data are analyzed in a computer-assisted manner and a speed and distances between axles of the vehicle are ascertained, a property of the rail-guided vehicle is ascertained in a computer-assisted manner on the basis of the ascertained speed and the ascertained distances between axles. In a checking step, a pattern of normal distances between axles is ascertained, in that a normal distance between axles calculated by taking into account a predefined normal speed is assigned to each of the ascertained distances between axles, and by taking into account their order, the normal distances between axles are merged to form the pattern, the pattern is compared with reference patterns and in the case of an identified conformity of the pattern with a reference pattern, a type linked to the reference pattern is assigned to the vehicle as a property.

Inventively it is provided, in other words, that the distances of the axles of the train formation are determined from the raw data of the axle counter as the train crosses. In particular, passenger trains such as ICE or regional trains are made up of fixed units, which, as a rule, remain together, from which no cars are uncoupled. For this reason there are patterns, which can be measured by coupling these units one behind the other multiple times and which are similar to one another. In addition, the train, in its entirety, produces a pattern that is typical for it. Passenger trains thereby have, as it were, a fixed "fingerprint," which is only changed by measurement errors, etc.

The advantage of using a pattern identification in train operation is due to the fact that parameters of the train operation such as closing times of a railroad crossing or track clearances can be flexibly adjusted to the vehicles assigned on the basis of the pattern identification of the examined property. Greater track utilization, by way of example, can be achieved hereby. Another example is the reliable identification of danger zones, for which safety measures can be introduced.

By contrast, there are other, as a rule variable and therewith not similar or identical patterns, in the case of freight trains, according to which and how many units are coupled together (the pattern of a freight train as a whole can be identified, however). The data may thereby be illustrated as multi-dimensional vectors whose components represent the distances between the axles, in other words, axle 1 to axle 2 through to axle n−1 to axle n (in the case of n axles of the train, in reality up to 250).

The meaning of the terms identical and similar should be understood in the sense of pattern identification. This means that a comparison of patterns can result in them being evaluated as identical or similar (or even as not identical and not similar, in other words, not related). This evaluation preferably occurs in a computer-assisted manner.

Patterns are understood as being identical if all test criteria when comparing patterns leads to the result that there is a conformity of the test criteria. Since the test criteria are based on measured values, a tolerance interval can be defined for the measurement in this case, within which interval the test criterion can lie in order to be understood as being identical.

Patterns are understood as being similar if an evaluation of the test criteria reveals that they match each other at least for the most part. It should be noted in this case that similarity also exists, therefore, if the patterns are identical.

For implementation of the pattern identification it must be established if the question can be answered in the affirmative that the criteria match each other at least for the most part. In general, the following correlation applies in this case for the identification of the property: the more stringent the criteria are for the identification of similarity, the greater the probability that the identified similar patterns actually always result in identification of the correct train type. The less stringent the criteria are for the identification of similarity, the higher the probability of a train type being incorrectly identified.

Irrespective of the stringency of the criteria, the inventive method works in the technical sense. During operation it should be ascertained, however, where in respect of the stringency of the criteria an optimum lies in relation to safe operation (more will follow on establishing the criteria).

One aspect important to the invention, which makes the identification of identical or similar patterns difficult, can be seen in that the vehicles can cross the axle counter at different speeds. This has an effect, as will be explained in more detail below, on the signal characteristic measured by the axle counter. Inventively the normal speed is defined in order to eliminate this effect. This is fixed for the method, wherein the value of the speed can be freely selected (but is then fixed).

If the measured signals are now normalized on the basis of the normal speed, the pattern may be calculated from normal distances, which apply to the normal speed. This pattern can then be compared with a reference pattern likewise created for this normal speed. This reference pattern can advantageously be used for a comparison of the pattern calculated from the normal distances irrespective of the speed of the vehicle that has crossed the axle counter. The information, which is contained in the signal about the train type, is namely unchanged at different speeds, and instead merely compressed or elongated by the speed. Mathematically, the information contained in the axle count signal is thereby invariant with respect to changes in speed.

Because, for a particular train or a particular train type, only one reference pattern has to be made available to enable a comparison with the patterns obtained from the normal distances, the use of storage capacity and the computational effort is advantageously reduced when comparing the patterns with the reference pattern. The inventive method can therefore be carried out particularly efficiently. In addition, the configuration of the computing environment, in which the method proceeds, is faster and simpler to finalize, and this increases cost-effectiveness in operation (more to follow in this regard).

The reference patterns can be stored, for example, in a memory unit. A server can provide the reference patterns, thereby enabling a comparison with the ascertained patterns. Another possibility resides in that the reference patterns are stored in a memory unit, which forms a component part of the axle counter. This results in the possibility of technically modifying the axle counter with a certain level of intelligence, in other words, as autonomously or partially autonomously acting units.

The advantage of reference patterns being stored in a memory unit is that they are available at any time and, if needed, can be retrieved without delay. The storage facilities can also store the various reference patterns in a track specific manner, so also only particular reference patterns are provided to particular axle counters at particular track sections.

In connection with the invention, "computer-aided" or "computer-implemented" can be taken to mean an implementation of the method in which at least one computer or processor executes at least one method step of the method.

The expression "computer" covers all electronic devices with data processing properties. Computers can be, for example, personal computers, servers, handheld computers, mobile wireless devices and other communication devices which process data in a computer-assisted manner, processors and other electronic devices for data processing, which can preferably also be combined to form a network.

In connection with the invention, a "processor" can be taken to mean, for example, a converter, a sensor for generating measuring signals or an electronic circuit. A processor can be, in particular, a Central Processing Unit (CPU), a microprocessor, a microcontroller, or a digital signal processor, possibly in combination with a memory unit for storing program commands, etc. A processor can also be taken to mean a virtualized processor or a soft CPU.

In connection with the invention, a "memory unit" can be taken to mean, for example, a computer-readable memory in the form of a Random-Access Memory (RAM) or data storage (hard drive or data carrier).

As "interfaces," these can be implemented in terms of hardware, for example wired or as a wireless connection, and/or in terms of software, for example as an interaction between individual program modules or program parts of one or more computer program(s).

A "Cloud" should be taken to mean an environment for "Cloud computing." What is meant is an IT infrastructure, which is made available through interfaces of a network such as the Internet. As a rule, it includes storage space, computing power or software as a service without it having to be installed on the local computer using the Cloud. The services offered in the context of Cloud computing include the entire spectrum of information technology and contains, inter alia, infrastructure, platforms and software.

"Program modules" should be taken to mean individual functional units, which enable an inventive program sequence of method steps. These functional units can be realized in a single computer program or in a plurality of computer programs that communicate with each other. The interfaces realized herein can be implemented in terms of software inside a single processor or in terms of hardware if a plurality of processors is used.

Unless stated otherwise in the following description, the terms "create," "establish," "calculate," "generate," "configure," "modify" and the like preferably refer to processes, which generate and/or change data and/or transfer the data into other data. The data exists, in particular, in the form of physical variables, for example as electrical pulses or also as measured values. The necessary instructions program commands are compiled in a computer program as software. Furthermore, the terms "send," "receive," "read in," "read out," "transmit" and the like refer to the interplay of individual hardware components and/or software components through interfaces.

According to one embodiment of the invention, it is provided that each of the distances between axles is ascertained by taking into account an individual speed of the vehicle applicable to the relevant distance between axles.

If, as a generalization, accelerations are permitted during the measurement, the acceleration between two adjacent wheels can be regarded as approximately constant and be estimated from the data. The acceleration in that configuration is more or less constant because, due to the inertia of the vehicle, only a negligible change in the acceleration can ever occur, at least between two axles. With the aid of the speed it is therefore again possible to back-calculate (in other words, normalize) the measured values of the relevant axle counter to the normal speed (assuming an acceleration of zero), even in the presence of an instantaneous ("constant") acceleration. This normal speed, which is now assumed for the relevant distance between axles, corresponds to the individual speed applicable to it.

According to one embodiment of the invention, it is provided that the individual speed is calculated as the average speed, which the vehicle has in the time period between the passing of the axle counter through the axles defining the distance between axles.

The average speed advantageously represents a comparatively easy-to-calculate criterion, which the actual speeds comes close to from axle to axle. This may be calculated, for example, by detecting the time which elapses between one particular axle passing the axle counter and the following axle passing and, when the distance of the axles is known (knowledge of the pattern pertaining to the vehicle, acknowledgement of a result of an assignment), the average speed is calculated from this. The average speed may also be calculated in that the time, which elapses due to the passing of one particular axle from an axle counter to the next axle counter, is detected and, when the distance of the axle counters is known, the speed is calculated from this.

According to one embodiment of the invention, it is provided that the average speed is calculated from the two speeds of the axles calculated by the axle counter on the basis of axles defining the distance between axles.

This embodiment of the invention assumes that the instantaneous speed of the wheel of the vehicle that is crossing can be measured by the axle counters used. In this case, one speed value is available for each axle. If a vehicle is accelerated or decelerated (and this denotes a negative acceleration), the measured value for the speed changes for each axle. For the relevant distance between axles, the mean of speeds of the axles defining the distance between axles advantageously produces a good, approximated value for the individual speed, therefore.

According to one embodiment of the invention, it is provided that the signal characteristic is smoothed before ascertaining the distances between axles.

The smoothing measure takes account of the fact that it can be difficult to accurately estimate the time interval between successive wheels if it is not clear when a wheel or the center of the wheel has reached the sensor since the raw data is normally impaired or noisy to a greater or lesser extent. The raw time series (measured values of the axle counter) is smoothed with a filter therefore, for example with a wavelet transformation or in simple cases, with a moving average. A sufficiently smooth time series is obtained as a result and for example the center of the wheel (as a maximum) or other characteristics of the wheel (for example, by way of threshold values) can be estimated. These values are ascertained for each wheel and then form the basis of time measurements.

According to one embodiment of the invention, it is provided that in a further checking step, the overall length of the vehicle is ascertained as a further property of the vehicle. According to a further embodiment of the invention, it is provided that measured speeds are subjected to a plausibility check in respect of direction and/or value and/or the overall length and the result of the plausibility check is output.

From the ascertained patterns of the vehicles it is possible to derive test conditions with which the plausibility of signal can be checked, for example should the speed be less than the speed restriction (optionally by taking into account a tolerance range). Or the speeds should all have the same sign (otherwise travel would have been in the backwards direction, and this does not normally occur under real conditions, at least on a clear track). If a plausibility check is failed, the signal is conservatively evaluated, for example the train type is set as unknown.

Following the plausibility check, all static rules, which result from vehicle or track models, are applied. For example if the longest passenger train is 500 m long, all longer trains are automatically classified as freight trains (optionally by taking into account a tolerance range). Or trains having a speed of more than 160 km/h are classified as passenger trains. More complicated rules about the derived data can also be formed, however: for example, trains with acceleration that changes a lot are classified as unknown because this is either an extraordinary case of operation or an attack.

The TBV (ban on trains meeting in a tunnel) before a tunnel on a new route can serve as a further example. In this case, as a rule, switching does not occur and nor does reversing, not even after a SPAD (signal passed at danger). The speed restriction for the types of train is known.

In the plausibility step, important physical parameters, such as the speed v for each wheel, in the case of successive wheels the acceleration a, the length of the train etc. are therefore ascertained from the raw signal of the time series.

Apart from detecting the axle count, the axle counter, due to the customary configuration as a dual sensor system, is also basically suitable for ascertaining further data such as that mentioned above. In addition, it is relatively easily possible to supplement the axle counter by way of simple sensors, which for example the axle load as the train crosses.

The following measuring principles, by way of example, can be used:

- direction of travel of the train: by comparing the influence in the case of dual sensors (for example by evaluation of the time delay when generating signals),
- speed of the train as an axle crosses: from the spacing of the dual sensors, for example by evaluation of the time delay when generating signals or the time interval of the passing of the estimated center of the wheel in the case of known distances between axles,
- average speed during crossing and/or the acceleration during crossing: from the averaging over different wheels or numerical derivation of the speed,
- wheel diameter: from the duration of an influencing of the axle counter.

A set of parameters suitable for the application is advantageously selected from a set of parameters ascertained in this way. For example, the wheel diameter can be omitted if it is more or less the same for all trains on the track. For the parameters under consideration, location-specific, representative data is now gathered or measured and classified, for example passenger train, freight train. This is a finite number of integral or real-valued measured values, for example this could be the speed and the number of axles, to give a clear two-dimensional example in this case. In other words, in principle, a classification task is obtained, as described below in relation to FIG. 5.

Overall, the ascertainment of further parameters as additional properties in addition to the patterns to be compared makes the identification of properties of vehicles more robust against errors. Advantageously, a higher level of reliability can be achieved in the identification of trains, so rail traffic can be controlled more effectively. Which parameters should be taken into account for the rail traffic in the case of an existing control task then depends on the circumstances of the individual case. They should be appropriately selected when devising the control method.

According to one embodiment of the invention, it is provided that a machine learning method is evaluated for the first checking step and/or the further checking step.

Machine learning advantageously enables an optimization of processes that are running, in other words, the reliable identification of the train properties, in particular types of train, during operation. The system can also automatically adapt to changing operating conditions hereby. For example, additional patterns can be created if a new type of passenger train is being used on a particular section of a track. For example, neural networks or also other facilities with artificial intelligence can be used for this purpose.

In the context of this invention, artificial intelligence (hereinafter also abbreviated to AI) should be understood in the narrower sense as computer-assisted machine learning (hereinafter also abbreviated to ML). It relates to the statistical learning of the parameterization of algorithms, preferably for complex applications. The system identifies and learns patterns and principles in the acquired process data by using ML and on the basis of previously input learning data. Independent solutions to problems that occur can be found by way of ML and with the aid of suitable algorithms. ML is divided into three fields—supervised learning, unsupervised learning and reinforcement learning, with more specific applications, for example regression and classification, structure identification and prediction, data generation (sampling) or autonomous action.

With supervised learning, the system is trained by the correlation of input and associated output of known data and in this way learns approximatively functional correlations. In this case, it is a matter of the availability of suitable and adequate data because the system learns incorrect functional correlations if it is trained with unsuitable (for example, non-representative) data. With unsupervised learning, the system is likewise trained with sample data but only with input data and without correlation with a known output. It learns how to form and expand data groups, and this is typical of the application, and where deviations or anomalies occur. As a result, applications may be described and error states discovered. With reinforcement learning, the system learns by way of trial and error in that it proposes solutions to given problems and receives a positive or negative assessment of this proposal through a feedback function. Depending on reward mechanism, the AI system learns to execute appropriate functions.

Machine learning can be carried out by artificial neural networks (hereinafter abbreviated to ANN), for example. Artificial neural networks are usually based on the networking of a large number of neurons, for example McCulloch-Pitts neurons or slight modifications thereof. Basically other artificial neurons can also be used in ANN, for example the high-order neuron. The topology of a network (the allocation of connections to nodes) has to be determined depending on its task. The training phase, in which the network "learns," follows after the construction of a network. A network can learn by way of the following methods, for example:

- development of new connections
- deleting existing connections
- changing the weighting (the weights of neuron j in relation to neuron i)
- adjusting the threshold values of the neurons if they have threshold values
- adding or deleting neurons
- modifying activation, propagation or output function.

In addition, the learning behavior changes when the activation function of the neurons or the learning rate of the network changes. In practical terms, an ANN primarily learns by modification of the weights of the neurons. An adjustment of the threshold value can also be taken care of in this case by way of an on-neuron. As a result, ANN are capable of learning complicated non-linear functions through a learning algorithm, which by way of an iterative or a recursive approach attempts to determine all parameters of the function from available input values and desired output values. ANN are an instance of the connectionistic paradigm since the function includes a large number of simple, similar parts. Only in their sum does the behavior become complex.

According to one embodiment of the invention, it is provided that the machine learning method is only applied when the result of the plausibility check is positive.

An additional advantage resides, as already explained, in the AI pattern identification being supported by track- and vehicle-specific testing and plausibility conditions. It is important in this connection to utilize mathematical invariants of the information contained in the signal in the plausibility check.

The fundamental advantage lies in that the dimensionality and complexity of the problem to be assessed is drastically reduced as a result and much less data is required for training and validation of the AI algorithm by machine learning.

In addition, so-called adversarial attacks are made more difficult. An adversarial attack in the context of artificial intelligence (AI) or machine learning is taken to mean the use of adversarial examples for manipulation of the classification results. An adversarial example is a specifically manipulated input signal in an artificial neural network, which intentionally misleads the network to incorrect classifications. The manipulation is undertaken in such a way that a human observer does not notice it or does not identify it as such. For example, with a neural network trained for object identification, the pixels of an image could be easily changed so these changes are not visible to humans, but the network incorrectly assigns the objects on the image.

The susceptibility to adversarial examples could be demonstrated in all fields of application of neural networks. Due to the increasing successes of deep neural networks and their use in safety-critical tasks, as in autonomous driving, adversarial attacks and methods for interception or identification of such adversarial examples are increasingly coming to the fore.

According to one embodiment of the invention, it is provided that probability densities for the properties are ascertained from the measurement data of a large number of measurements.

Knowledge of the probability densities makes it possible to define classification limits for the assignment of the properties. The method is advantageously very robust in respect of the classification limits because in the case of the inventive, comparatively low-dimensional problems, the probability densities for the various categories can be estimated from the data (for example with estimation of the density of the measurement results) and the error probabilities for an incorrect classification can also be ascertained thereby.

With the objects of the invention in view, there is also provided an apparatus for determining properties of rail-guided vehicles, comprising at least one axle counter for detecting measurement data as the vehicles cross, a computer, which is adapted to analyze the measurement data and ascertain a speed and distances between axles of the vehicle, and on the basis of the ascertained speed and the ascertained distances between axles, to ascertain a property of the vehicle. The computer is also adapted to carry out a method according to the invention when ascertaining the property.

Advantages may be achieved with the apparatus, which have already been explained in connection with the method described in more detail above. That stated in relation to the inventive method also applies accordingly to the inventive apparatus.

With the objects of the invention in view, there is furthermore provided a computer program product with program commands for carrying out the method and/or exemplary embodiments thereof, moreover, wherein in each case the method and/or its exemplary embodiments can be carried out by the computer program product.

With the objects of the invention in view, there is concomitantly provided a provisioning apparatus or computer-readable medium for storing and/or providing the computer program product. The provisioning apparatus or computer-readable medium is, for example, a memory unit, which stores and/or provides the computer program product. Alternatively and/or in addition, the provisioning apparatus or computer-readable medium is, for example, a network service, a computer system, a server system, in particular a distributed, for example cloud-based computer system and/or virtual computer system, which the computer program product preferably stores and/or provides in the form of a data stream.

Provision occurs in the form of a program data block as a file, in particular as a download file, or as a data stream, in particular as a download data stream, of the computer program product. This provision can also occur, for example, as a partial download, however, which is composed of several parts. A computer program product of this kind is read into a system, for example using the provisioning apparatus, so the inventive method is executed on a computer.

Further details of the invention will be described below with reference to the drawings. Identical or corresponding elements of the drawings are in each case provided with identical reference characters and will only be explained multiple times insofar as differences arise between the individual figures.

The exemplary embodiments explained below are preferred embodiments of the invention. In the exemplary embodiments, the described components of the embodiments in each case represent individual features of the invention, which are to be considered independently of each other, which in each case also develop the invention independently of each other and should therewith also be regarded as an integral part of the invention individually or in a combination other than that disclosed. The described components can also be combined with the features of the invention described above, moreover.

Other features which are considered as characteristic for the invention are set forth in the appended claims.

Although the invention is illustrated and described herein as embodied in a method and an apparatus for identifying properties of a vehicle, a computer program product and a provisioning apparatus for storing and/or providing the computer program product, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
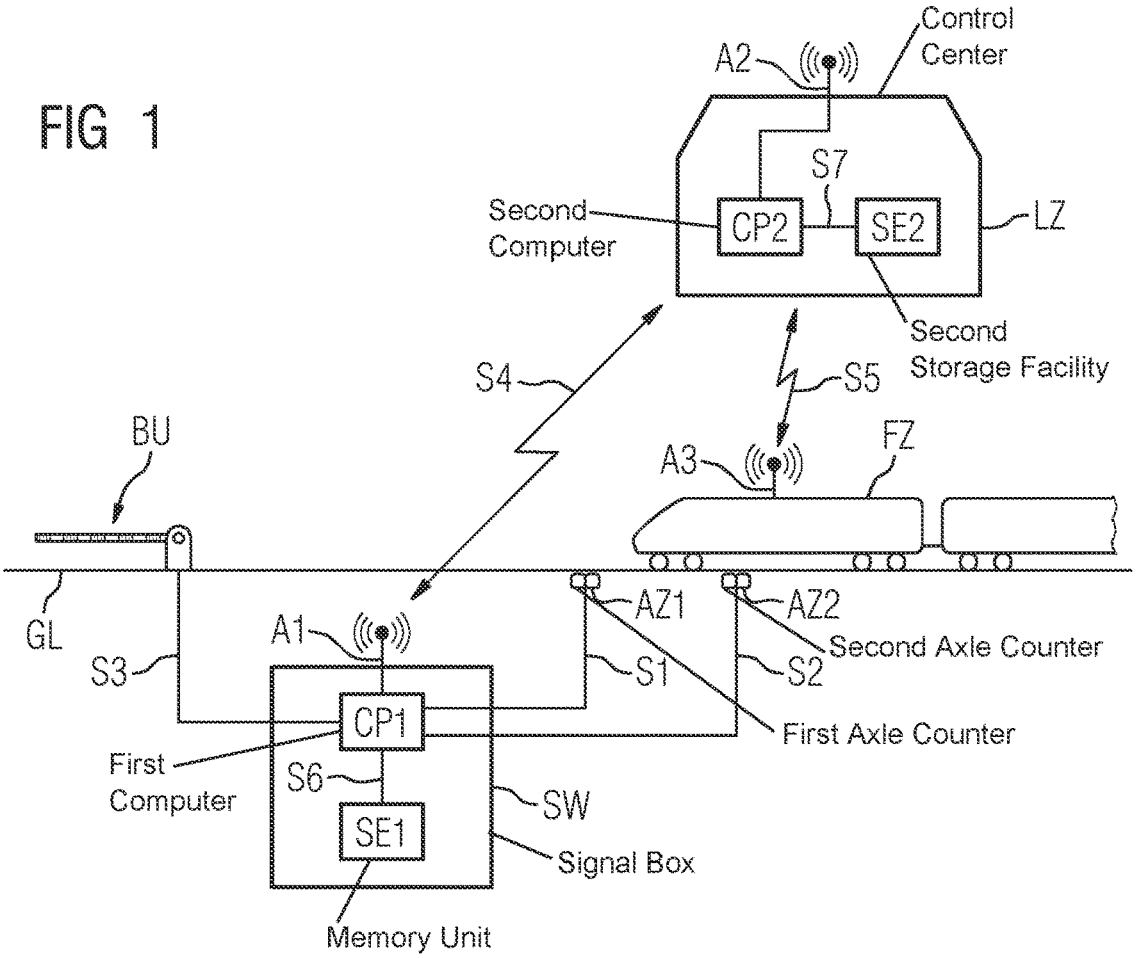
FIG. 1 is a diagrammatic, side-elevational view of an exemplary embodiment of the inventive apparatus with its interrelationships and with a computer infrastructure (computing environment) of the apparatus as a block diagram, with the individual functional units containing program modules, which in each case can run in one or more processor(s) and the interfaces which can accordingly be configured in terms of software or hardware.

Referring now to the figures of the drawings in detail and first, particularly, to FIG. 1 thereof, there is seen a rail system with a rail GL, a control center LZ, which has a second computer CP2 and a second memory unit SE2 connected thereto by a seventh interface S7, and a signal box or tower SW. A vehicle FZ in the form of a train travels on the rail GL in the direction of a railroad crossing BU. A first axle counter AZ1 and a second axle counter AZ2 are installed on the rail GL, and these are adapted in a manner known per se to count the axles of the vehicle FZ.

The axle counter AZ1 is connected to the signal box or tower SW, strictly speaking to a first computer CP1 present in this signal box or tower, through a first interface S1, and the second axle counter AZ2 is connected to the first computer CP1 through a second interface S2. In addition, the first computer CP1 has a third interface S3 for the railroad crossing BU. In addition, the first computer CP1 is connected to a memory unit SE1 through a sixth interface S6.

The signal box or tower SW has a first antenna system A1, the control center LZ has a second antenna system A2, and the vehicle FZ has a third antenna system A3. Both the communication of the signal box or tower SW with the control center LZ through a fourth interface S4 and the communication of the vehicle FZ with the control center LZ through a fifth interface S5 is possible hereby. The fourth interface S4 and the fifth interface S5 are wireless interfaces in this regard. The first interface S1, the second interface S2 and the third interface S3 can be both wired as well as wireless interfaces, with the antenna technology, which would be necessary for forming wireless interfaces, not being illustrated for the latter case.

If the vehicle FZ moves on the rail GL in the direction of the railroad crossing BU, the axles of the vehicle FZ firstly pass the second axle counter AZ2 and then the first axle counter AZ1. The acquired measured values can be transmitted to the first computer CP1 through the first interface S1 and the second interface S2, with the first computer CP1 (and also the second computer CP2) being adapted for carrying out the inventive method. The first computer CP1 can also undertake the actuation of the railroad crossing BU directly. Another possibility lies in the first computer CP1 being connected to a further computer (not illustrated in FIG. 1) through the third interface S3, which computer is used through a further interface for actuation of the railroad crossing BU.

Figure 2:
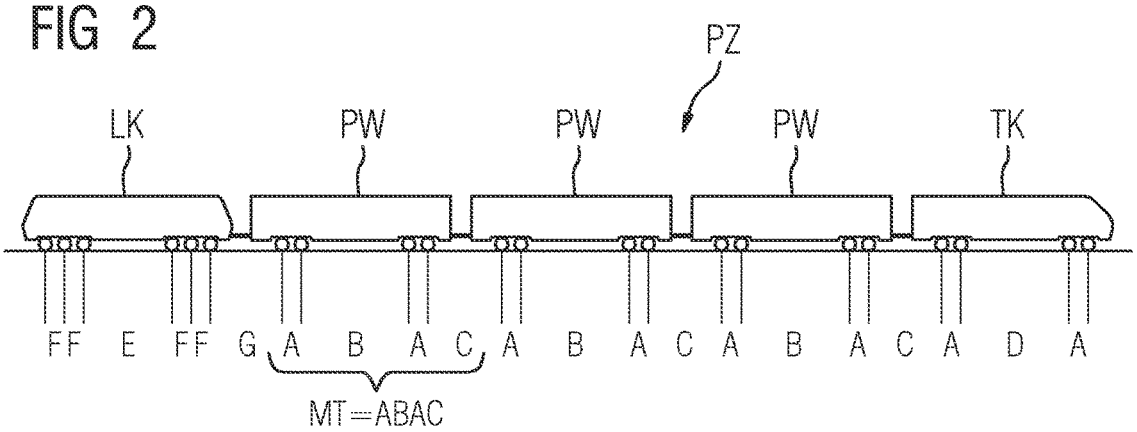
FIGS. 2 and 3 are side-elevational views showing partly identical or similar patterns of distances between axles for a passenger train and a freight train.

FIG. 2 illustrates a passenger train PZ travelling on the rail GL as the vehicle FZ in FIG. 1. This passenger train PZ is formed of a locomotive LK, a plurality of passenger cars PW and a power car TK at the end of the passenger train PZ opposite the locomotive LK.

The distances between the individual axles (indicated by wheels) are also schematically illustrated. It has been found that different distances between axles occur multiple times in the passenger train PZ, so the sequence of distances between axles can be examined for the existence of patterns. The distances between axles are marked by the uppercase letters A to G. The sequence of distances between axles is formed of FFEFFGABACABACABACADA.

If the locomotive LK and the power car TK are disregarded, since these differ in respect of their distances between axles from the passenger car PW, a sequence of distances between axles, which is continuously repeated, thus results for the successive passenger cars, which are identical in construction. In this respect they form a pattern MT, which is marked for the passenger car PW following the locomotive LK with a curly bracket. The sequence of distances between axles in the pattern MT illustrated in FIG. 2 is ABAC. This sequence of distances between axles also results for the two subsequent passenger cars.

Figure 3:
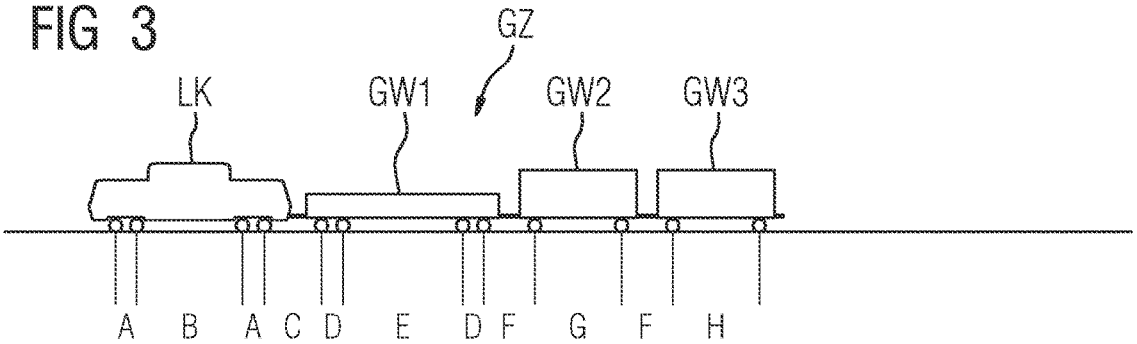

The situation is different in the freight train GZ illustrated in FIG. 3 on the rail GL, which is composed of a locomotive LK and a first freight car GW1, a second freight car GW2 and a third freight car GW3. These have different lengths and numbers of axles, so a plurality of different distances between axles result, which are provided the uppercase letters A to H. In FIG. 3 it becomes clear that repeating patterns may in no way be discovered in the illustrated sequence ABACDEDFGFH, and this allows a freight train to be inferred.

Figure 4:
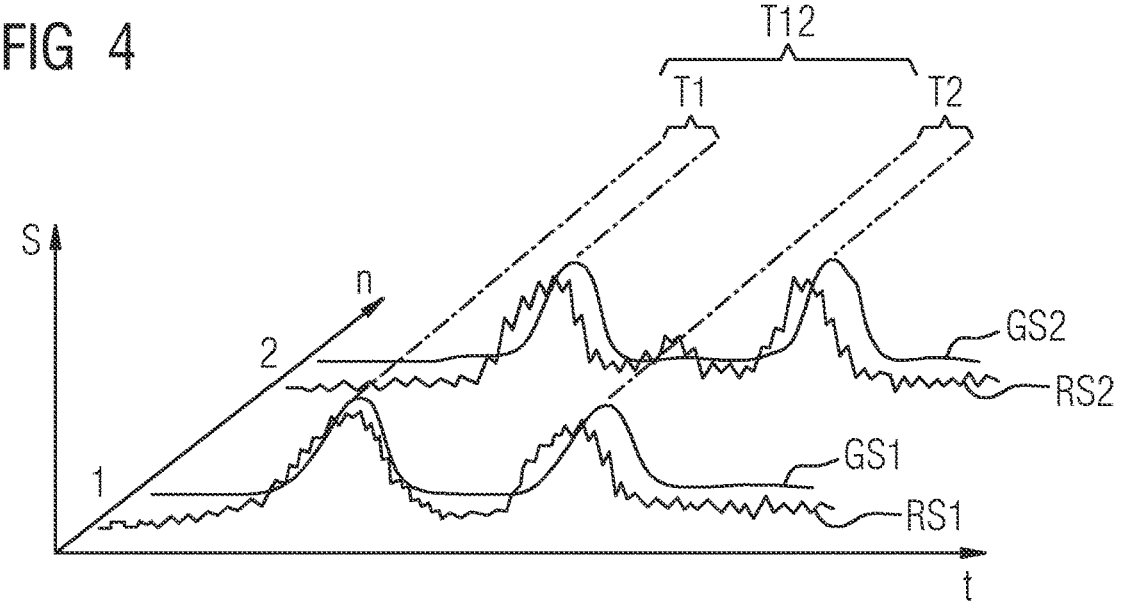
FIG. 4 is a graph of the signal strength s as a function of the time t of a dual axle counter with two sensors n equal to 1 and 2 for an exemplary embodiment of the inventive method.

FIG. 4 illustrates the signal characteristics of a dual axle counter as a function of the time t. Two individual sensors are installed in this counter, so there are two signal characteristics n, which are marked by 1 and 2 in FIG. 4.

It can be seen in FIG. 4 that the two individual sensors generate a first raw signal RS1 and a second raw signal RS2, which are transferred by a smoothing step of the method into a first smoothed signal GS1 and a second smoothed signal GS2. These are now available for a further evaluation.

The individual sensors 1 and 2 are installed one behind the other in the dual axle counter, so that when a wheel passes there is a time delay in the generation of the sensor signals. FIG. 4 illustrates this time delay in the first time period T1 and in the second time period T2. This time period can be used, for example, to calculate the speed of the wheel passing the sensor and thereby of the vehicle.

The first time period T1 is to be assigned to a first wheel and the second time period T2 to a second wheel, it being possible for these wheels to pertain, for example, to a truck or bogie of a vehicle. With known speed (calculated by way of the first time period T1 and/or the second time period T2), the distance A of the axles of the truck (cf. FIGS. 2 and 5) can be calculated from the resulting time period T12, which lies between the detection of the first wheel and the detection of the second wheel.

Figure 5:
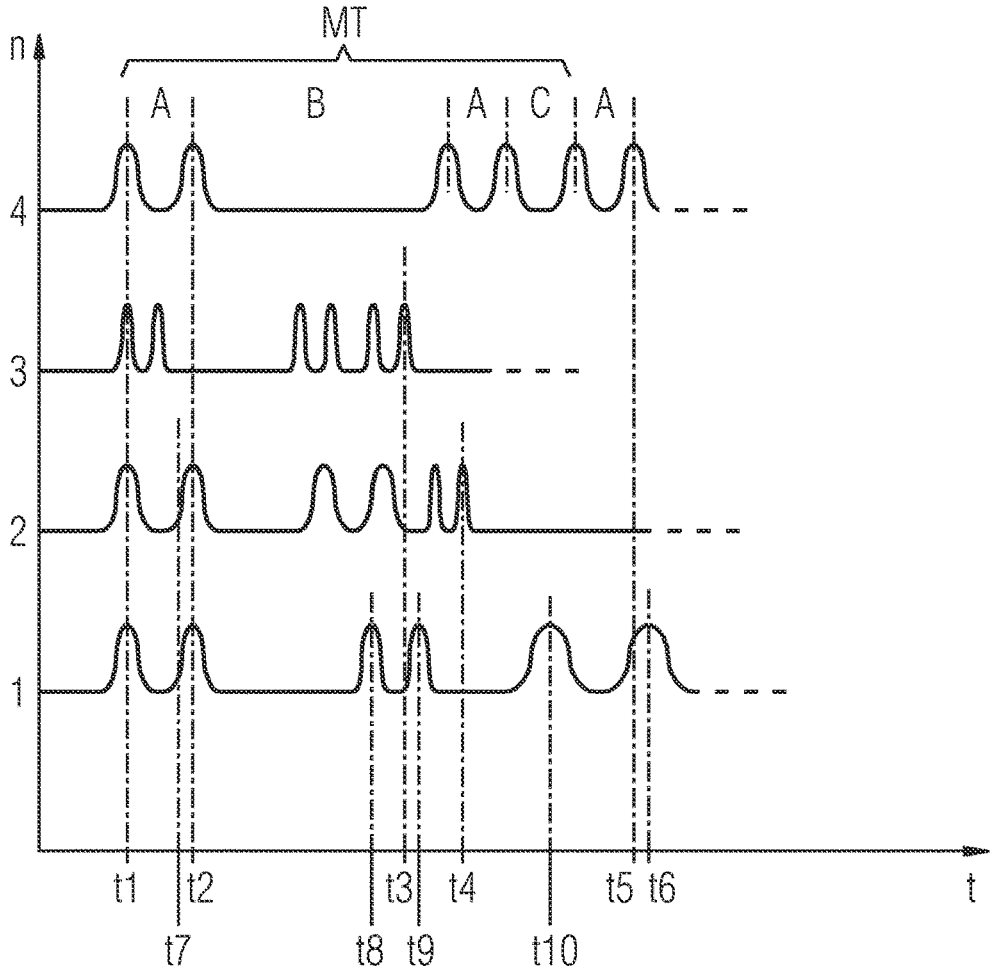
FIG. 5 is a graph which shows different signal characteristics n of an axle counter as a function of the time t as a graph for an exemplary embodiment of the inventive method.

FIG. 5 illustrates the signal characteristics n=1 . . . 4 of in each case only one sensor of a dual axle counter on the basis of the pattern MT in FIG. 2. The different examples 1 to 4 represent different speed and acceleration states of the vehicle, which crosses the axle counter. The first signal indicating an axle (as also illustrated in FIG. 4 by a signal rise and subsequent signal drop) lies in all cases 1 to 4 at an instant t1. The different characteristics of the signal characteristics 1 to 4 will be explained on the basis of the further instants, which are illustrated in FIG. 5.

The signal characteristic 4 is a signal characteristic in which by way of calculation, the normal distances between axles A, B and C are calculated since the vehicle moves at the predefined normal speed in this case. In other words, it would not be necessary to convert this signal characteristic by taking into account the predefined normal speed since it could be compared directly with the reference patterns.

The signal characteristic 3 results when the vehicle crosses the axle counter at a constant speed, with this speed being higher than the normal speed. This may be seen in FIG. 5 in that, compared with the signal characteristic 4, the signal characteristic 3 is compressed on the time axis. While the signal characteristic 4 extends from instant T1 to instant T6, the signal characteristic 3 ends earlier at instant T3.

The signal characteristic 2 results when the vehicle is constantly accelerated as it crosses the axle counter. It can be seen in this case that the signal characteristic 2 is not compressed by a constant factor like the signal characteristic 3, instead the compression of the signal increases continuously. The second peak of the signal characteristic is therefore already shifted slightly at instant T7 compared with instant T2 in the second peak of the signal characteristic 4. It is assumed that the vehicle had the same speed at instant T1 as the vehicle in the case of signal characteristic 4, in other words, the normal speed. The instant T7 is therefore earlier than the instant T2. The signal characteristic thereby ends overall at instant T4 earlier than the signal characteristic 4, which ends at instant T6.

The signal characteristic 1 shows a non-constant acceleration behavior of the vehicle as it crosses the axle counter. On the basis of the instants T1 and T2 it may be seen that the vehicle is en route at normal speed at this instant. The instants T8 and T9 show that in this case there is a greater speed, so that an acceleration has taken place (t8 and T9 lie closer together than T1 and T2). In addition, T10 and T6 show that in this case there is a lower speed than at instant T1 and T2 (T10 and T6 have a greater distance than T1 and T2). It should be noted in this connection that the signals are merely representative and further axles could lie between the instants T2 and T8 and T1 and T10, which would generate further peaks (not illustrated).

According to the method described in relation to FIG. 4, a distance between axles may be calculated for all signal characteristics illustrated in FIG. 5 in each case by taking into account adjacent peaks. By taking into account the measured speeds and individual speeds calculated therefrom (for example, average speeds calculated as individual speeds, in respect of adjacent axles in each case), these may be normalized in each case, so that, irrespective of the speed or acceleration behavior of the vehicle, the normal distances A, B and C can be calculated. The method used in this case is described in relation to FIG. 6.

Figure 6:
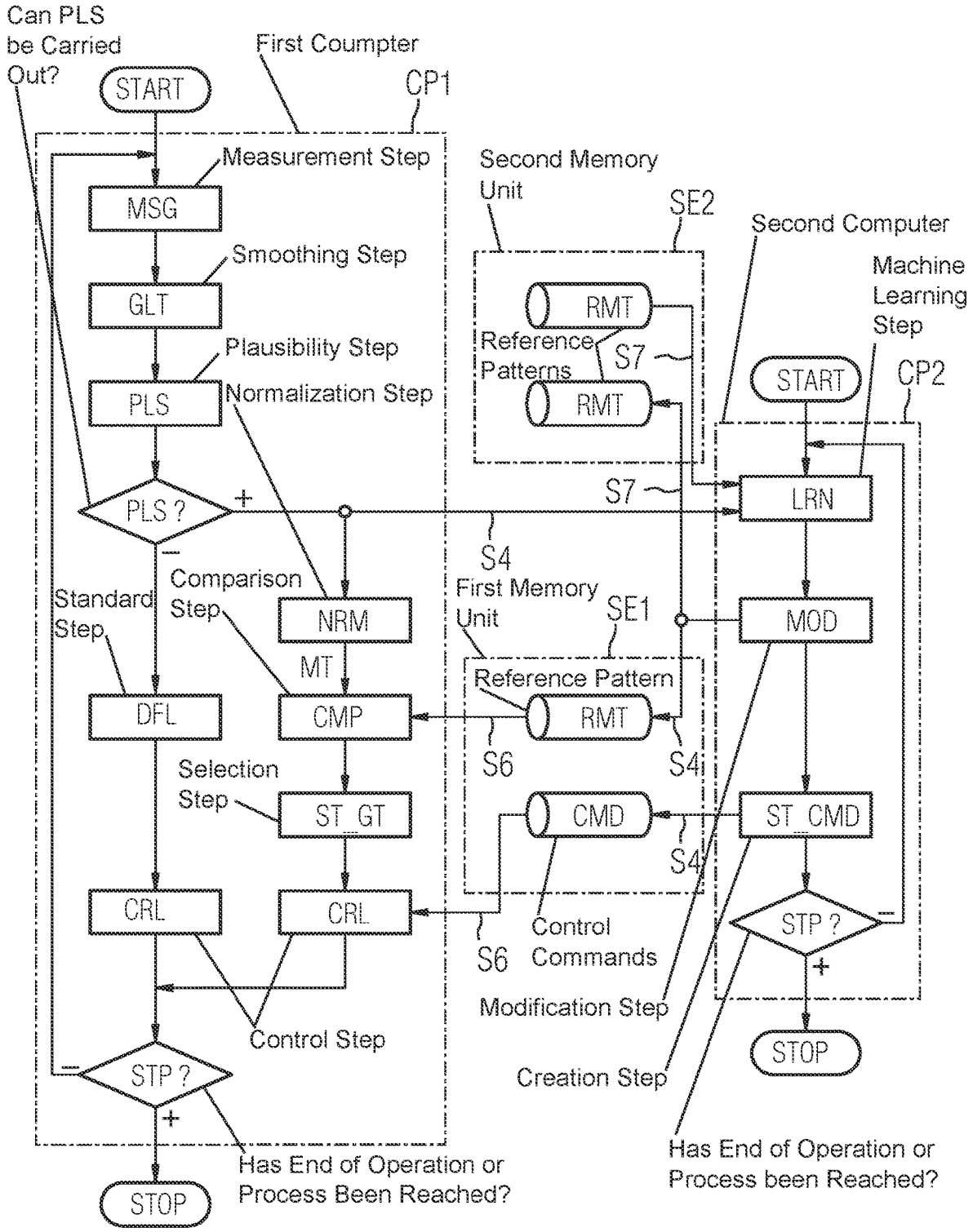
FIG. 6 is a flowchart of an exemplary embodiment of the inventive method, with the functional units and interfaces in FIG. 1 being indicated by way of example and if possible for the individual method steps to be implemented individually or in groups by way of program modules and the functional units and interfaces in FIG. 2 being indicated by way of example.

FIG. 6 illustrates the inventive method, which is being carried out in a divided manner, by way of example, by the first computer CP1 and the second computer CP2. The first memory unit SE1 and the second memory unit SE2 are used. The method starts both in the computer CP1 and in the computer CP2. In the computer CP2, a measurement step MSG is carried out, which can generate, by way of example, signal characteristics in FIGS. 4 and 5. A smoothing step GLT then follows for generating a smoothed signal GS1, GS2 from the respective raw signals RS1, RS2 (cf. FIG. 4). A plausibility step PLS is then carried out in which the particular properties of the signal characteristic can be used to be able to carry out an assessment in advance as to whether the signal characteristic represents a realistic operating state of the vehicle. Measuring errors, for example, can be identified hereby, but also adversarial attacks on the apparatus, it being possible for both to result in undesirable operating states and even accidents.

In a query step PLS? it is checked whether or not the plausibility check could be successfully carried out. If this is not the case, a standard step DFL is carried out, which can safely operate the system or transfers it into a safe state. Safe operation is possible, for example in a case of a railroad crossing, if for the closing time of the railroad crossing the most adverse case of a fast approaching passenger train is assumed and the barriers are activated early. An incident can thereby be ruled out for even the most adverse case that can be assumed. One example of a safety measure is the initiation of emergency braking for the vehicle.

If the plausibility check could be carried out successfully then the pattern MT generated with the measurement in the first computer CP1 carries out a normalization step NRM. This proceeds in accordance with the principles explained in FIG. 5, so that, as a result, the pattern MT with normal distances between axles is generated. This can be compared in a comparison step CMP with reference patterns RMT, which are stored in the first memory unit SE1 and are retrieved from there.

If a reference pattern RMT was identified, then in a selection step for the type of the vehicle ST_GT, for example a train type such as passenger train, local train or freight train can be selected. Subsequently in a control step CRL, control, for example of a train component, tailored to the identified train type can be carried out. For example, the closing time of a railroad crossing can be controlled as a function of the identified train type. Control commands CMD can be retrieved from the first memory unit SE1 for the purpose of modification of the control step CRL.

In addition, the result which has been checked for plausibility is transmitted to the second computer CP2. A machine learning step LRN is carried out in this computer, with the second computer CP2 being equipped with artificial intelligence, for example by applying a neural network. If the machine learning step was carried out successfully, a modification step MOD follows, which generates modified or new reference patterns RMT. For example, it was possible to identify that new high-speed trains with a greater number of cars are travelling on a particular track, on which the axle counter is installed. A corresponding reference pattern RMT is then stored accordingly in the second memory unit SE2.

In addition, suitable new control commands CMD can be generated on the basis of the learned modifications in a creation step for control commands ST_CMD for relevant reference patterns RMT. These are stored in the first memory unit SE1.

For the method in the first computer CP1 and the second computer CP2, a query STP? takes place as to whether the end of operation or the end of the process has been reached. If this is the case, the method is stopped. If this is not the case, the processes in the first computer CP1 begin with a renewed measurement step MSG and, as necessary, the process in the second computer CP2 begins with a renewed learning step LRN.

Figure 7:
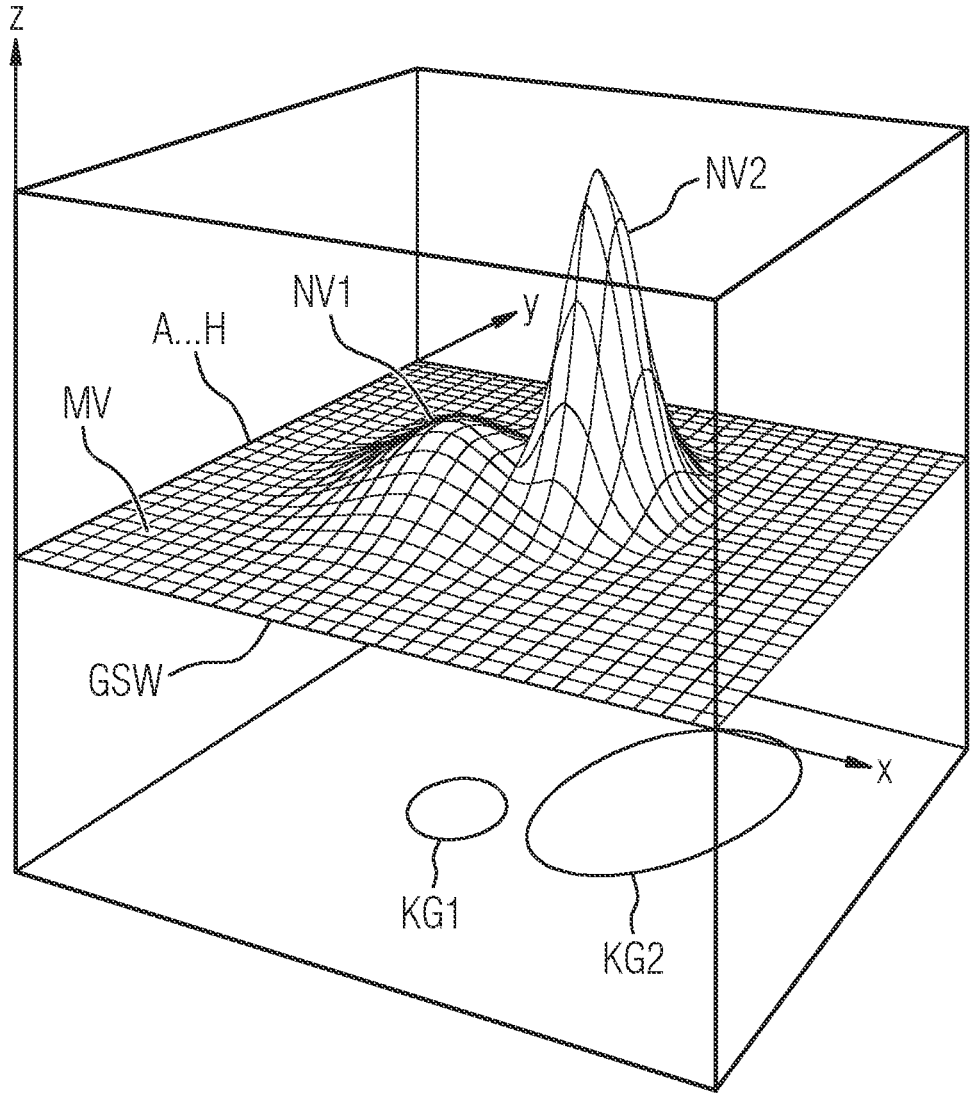
FIG. 7 is a diagram symbolically showing two normal distributions for ascertained measurement data in order to explain the principle of the invention.

FIG. 7 illustrates, by way of example, two parameters, inventively measured or determinable by the axle counter, in a plane, which could also be referred to as the x-y plane and on which the measured value distribution MV of the measured values becomes clear. According to this, the speed GSW would be illustrated on the x-axis and distances between axles A . . . H on the Y-axis. The z-axis serves to illustrate (for example, estimated) probability densities.

For the parameters under consideration, in this example location-specific, representative data is gathered or measured and classified, for example passenger train as normal distribution NV2 and freight train as normal distribution NV1, as already described above. This is a finite number of integral or real-valued measurement data of the axle counters, for example this could be the speed and the distance between axles to give a clear two-dimensional example in this case. In other words, in principle, a classification task is obtained as is schematically illustrated in FIG. 7.

Where representative data exists it is known how such problems of pattern identification can be solved with methods of machine learning, for example by way of neural networks. With this application in the case of axle counters, there is greater scope in setting the classification limits because with low-dimensional problems of this kind it is possible to also estimate the probability densities for the two classes from the data (for example with density estimation). The error probabilities for an incorrect classification can be ascertained thereby (cf. for example Duda et al.: Pattern Classification, Wiley, 2001), FIG. 5 shows this symbolically for a first normal distribution NV1 and a second normal distribution NV2, but, in principle this also works for distributions other than normal distributions.

If it is assumed in the example that the small ellipse would be the first classification limit KG1 for freight trains and the large ellipse the classification limit KG2 for passenger trains, then the error probabilities could be calculated with the estimated distributions. If the error classification probability for freight trains were to be too high, the classification limits would be changed. In the example in FIG. 7, a smaller ellipse would then be obtained for the first classification limit KG1. There can also be applications, however, where the classification errors are asymmetric, in other words, the errors do not have the same significance. For example, considering safety, it would be irrelevant in the case of time-controlled activation of a railroad crossing if a slow freight train were to be classified as a fast passenger train, whereas this would be dangerous in the case of a ban on trains meeting in a tunnel. In other words, in each case the safety aspect has to be considered in the evaluation of the types or probabilities of error.

The following is a summary list of reference numerals and the corresponding structure used in the above description of the invention:

GL rail
FZ rail-guided vehicle (rail vehicle)
BU railroad crossing
LZ control center
SW signal box or tower
A1 . . . A3 antenna
AZ1 . . . AZ2 axle counter
S1 . . . S7 interface
CP1 . . . CP2 computer
SE1 . . . SE2 memory unit
PZ passenger train
LK locomotive
PW passenger car
TK power car
GZ freight train
GW1 . . . GW3 freight car
A . . . H distance between axles
MT pattern
RMT reference pattern
MSG measurement step
GLT smoothing step
PLS plausibility step
PLS? query step: plausibility check taken place
DFL standard step
CRL control step
NRM normalization step
CMP comparison step
ST_GT selection step for type
CMD control commands
LRN machine learning step
MOD modification step
ST_CMD creation step for control commands
STP? query step: end of the process
S measurement signal
t time
t1 . . . t10 instants
T1 . . . T12 time periods
RS1 . . . RS2 raw signal
GS1 . . . GS2 smoothed signal

The invention claimed is:

1. A method for identifying properties of a rail-guided vehicle, the method comprising:

using an axle counter to detect measurement data as the rail-guided vehicle crosses the axle counter;

analyzing the measurement data in a computer-assisted manner and ascertaining a speed and distances between axles of the vehicle;

ascertaining a property of the rail-guided vehicle in a computer-assisted manner based on the ascertained speed and the ascertained distances between axles;

carrying out a checking step including ascertaining a pattern of normalized distances between axles by calculating a normalized distance between axles by taking a predefined normalized speed assigned to each of the ascertained distances between axles into account, and merging the normalized distances between axles to form the pattern by taking an order of the ascertained distances between axles into account;

comparing the pattern with reference patterns;

upon identifying a conformity of the pattern with a reference pattern, assigning a type linked to the reference pattern to the vehicle as a property; and using the type assigned to the vehicle to control a train component.

2. The method according to claim 1, which further comprises ascertaining each of the distances between axles by taking an individual speed of the vehicle applicable to a relevant distance between axles into account.

3. The method according to claim 1, which further comprises calculating an individual speed of the vehicle as an average speed of the vehicle in a time period during which the axles defining the distance between axles pass the axle counter.

4. The method according to claim 1, which further comprises calculating an individual speed of the vehicle from two speeds of the axles calculated by the axle counter based on the axles defining the distance between axles.

5. The method according to claim 1, which further comprises smoothing a signal characteristic before ascertaining the distances between axles.

6. The method according to claim 1, which further comprises carrying out a further checking step by ascertaining an overall length of the vehicle as a further property of the vehicle.

7. The method according to claim 1, which further comprises carrying out a further checking step by subjecting measured speeds to a plausibility check with regard to at least one of direction or value or overall length, and outputting a result of the plausibility check.

8. The method according to claim 7, which further comprises applying a machine learning method after at least one of the checking step or the further checking step.

9. The method according to claim 8, which further comprises applying the machine learning method only if the plausibility check could be successfully carried out.

10. The method according to claim 1, which further comprises ascertaining probability densities for the properties from measurement data of a number of measurements.

11. An apparatus for determining properties of rail-guided vehicles, the apparatus comprising:

at least one axle counter for detecting measurement data as the vehicles cross said at least one axle counter;

a computer configured to analyze the measurement data and ascertain a speed and distances between axles of a vehicle;

said computer configured to ascertain a property of the vehicle based on the ascertained speed and the ascertained distances between axles; and said computer configured to:

use an axle counter to detect measurement data as the rail-guided vehicle crosses the axle counter;

analyze the measurement data in a computer-assisted manner and ascertain a speed and distances between axles of the vehicle;

ascertain a property of the rail-guided vehicle in a computer-assisted manner based on the ascertained speed and the ascertained distances between axles;

carry out a checking step including ascertaining a pattern of normalized distances between axles by calculating a normalized distance between axles by taking a predefined normalized speed assigned to each of the ascertained distances between axles into account, and merging the normalized distances between axles to form the pattern by taking an order of the ascertained distances between axles into account;

compare the pattern with reference patterns;

upon identifying a conformity of the pattern with a reference pattern, assign a type linked to the reference pattern to the vehicle as a property; and use the type assigned to the vehicle to control a train component.

12. A non-transitory computer program product with program commands stored thereon that when executed on a computer carry out the method according to claim 1.

13. A non-transitory computer-readable medium for at least one of storing or providing the computer program product according to claim 12.

* * * * *